United States Patent [19]

Bonerb et al.

[11] Patent Number: 4,476,998

[45] Date of Patent: Oct. 16, 1984

[54] SIDE UNLOADING BIN FOR STORING AND DISCHARGING FREE-FLOWING GRANULAR MATERIAL

[76] Inventors: Timothy C. Bonerb; Vincent C. Bonerb, both of P.O. Box 2016, Buffalo, N.Y. 14219

[21] Appl. No.: 357,592

[22] Filed: Mar. 12, 1982

Related U.S. Application Data

[63] Continuation-in-part of Ser. No. 257,604, Apr. 27, 1981, Pat. No. 4,421,250, which is a continuation-in-part of Ser. No. 307,089, Sep. 30, 1981.

[51] Int. Cl.[3] ..... B65D 88/62

[52] U.S. Cl. ..... 222/61; 222/64; 222/154; 222/386.5; 222/389

[58] Field of Search ..... 222/154, 61, 64, 203, 222/252, 263, 412, 413, 386.5, 389; 52/195, 197; 414/304, 323; 406/134, 122; 198/555, 548

[56] References Cited

U.S. PATENT DOCUMENTS

| | | | |
|---|---|---|---|
| 1,587,174 | 6/1926 | Nash | 222/413 X |
| 2,722,171 | 11/1955 | Deringer | 222/386.5 X |
| 2,956,839 | 10/1960 | Hermanns | 222/386.5 |
| 4,169,543 | 10/1979 | Hall | 222/64 X |

FOREIGN PATENT DOCUMENTS

| | | | |
|---|---|---|---|
| 2062630 | 6/1972 | Fed. Rep. of Germany | 222/203 |
| 33107 | 2/1963 | Finland | 406/134 |
| 429496 | 7/1911 | France | 414/304 |
| 809057 | 2/1959 | United Kingdom | 222/252 |
| 1089874 | 11/1967 | United Kingdom | 222/386.5 |
| 1144162 | 3/1969 | United Kingdom | 52/197 |

*Primary Examiner*—Joseph J. Rolla
*Assistant Examiner*—Frederick R. Handren
*Attorney, Agent, or Firm*—Bernard, Rothwell & Brown

[57] ABSTRACT

A side unloading bin for storing and discharging free-flowing granular material, such as sugar, is supported on a floor capable of supporting the weight of the material in the bin and has side walls with a discharge opening near the bottom. A flexible, inflatable, generally cup-shaped, double-walled bag, having a slanted top supports the material on the floor, has its slanted top attached to the side walls, and is inflated to assist the discharge of the material through the discharge opening, particularly the material that will not discharge by gravity due to the angle of repose of the material. The discharge opening has a discharge gate and an openable hatch, to discharge to a conveyor. Controls operate from a material sensor near the discharge control and actuate inflation and deflation of the bag to ensure a continuous discharge of material.

8 Claims, 25 Drawing Figures

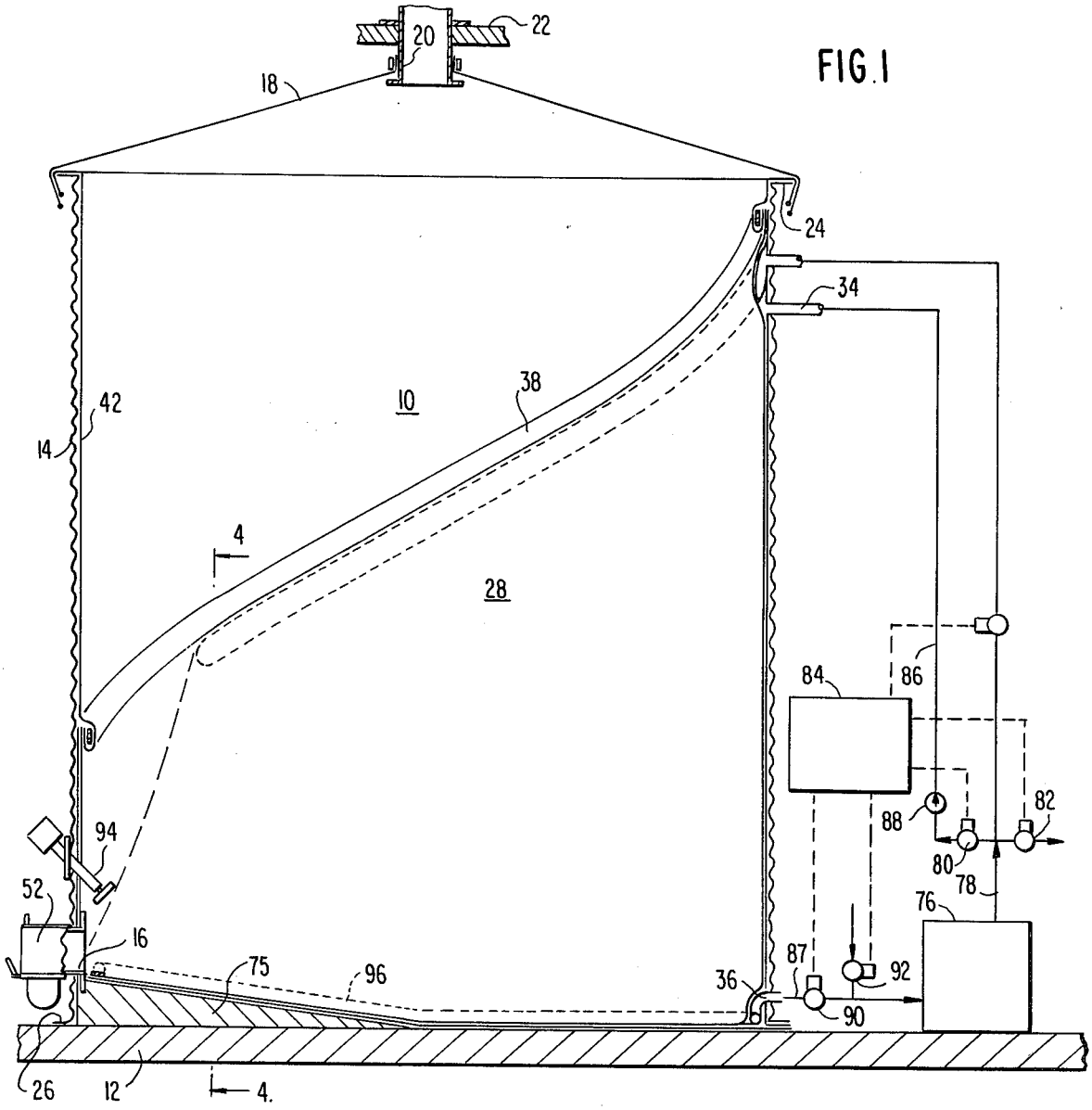
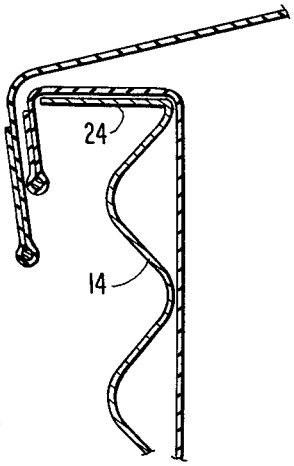
FIG.2
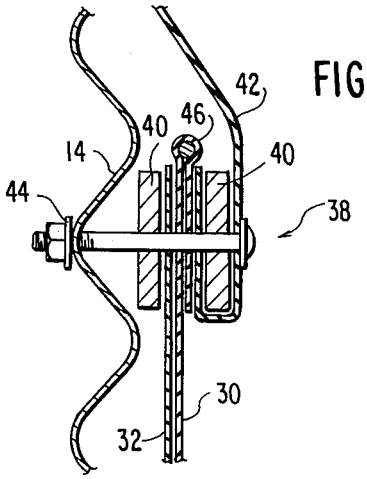
FIG.3

FIG. 5
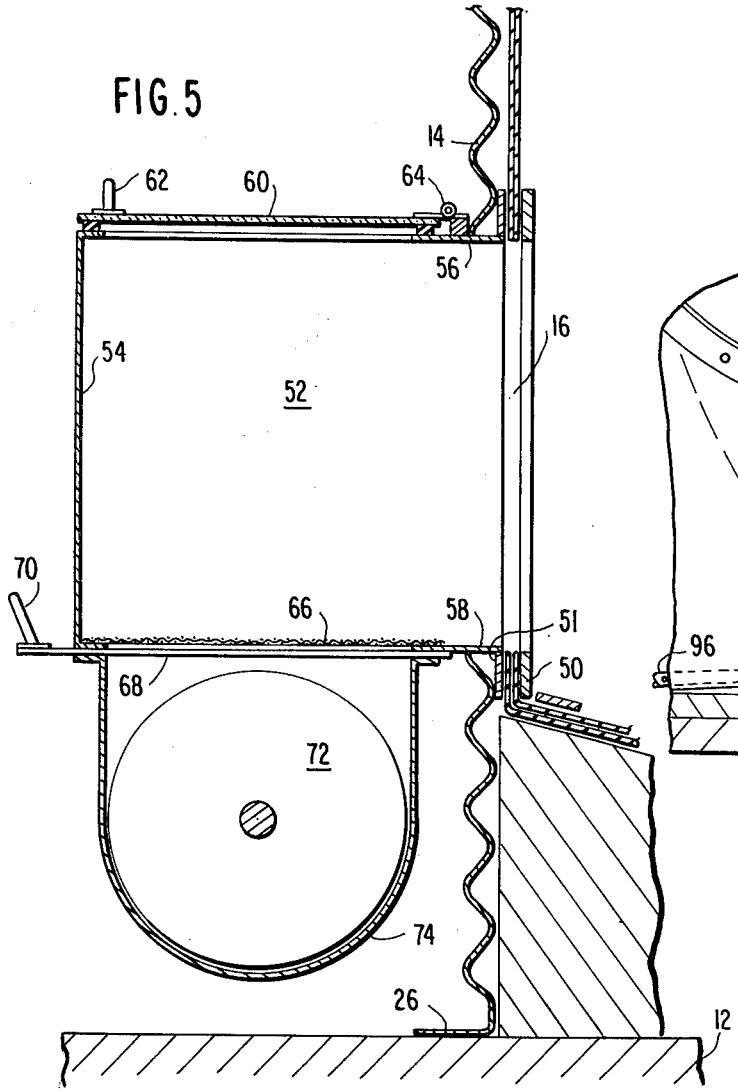
FIG. 4
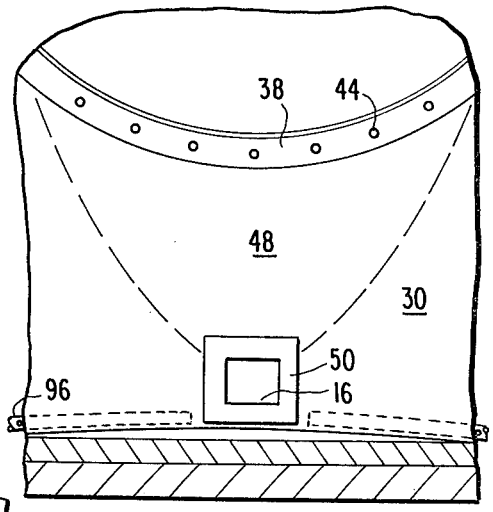
FIG. 7
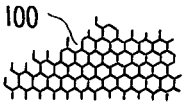
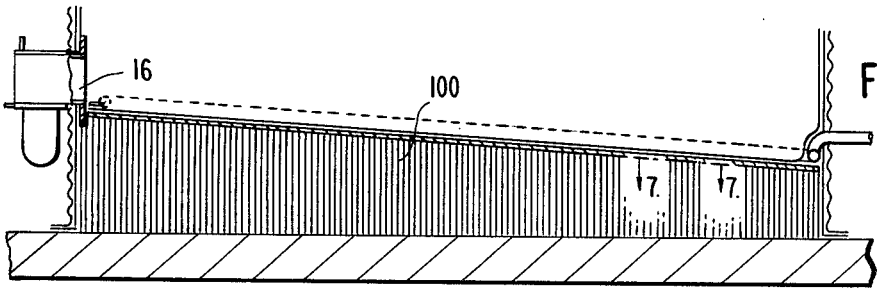
FIG. 6
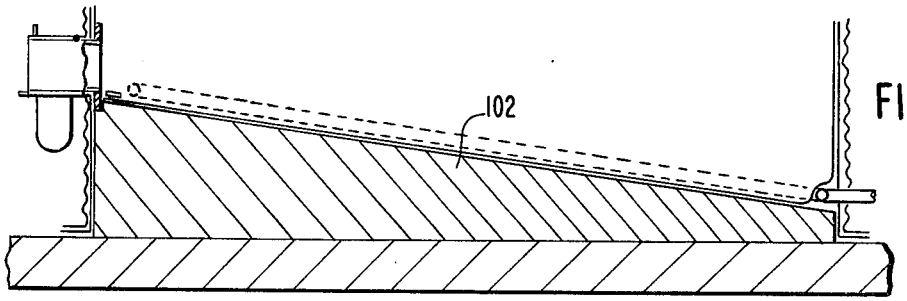
FIG. 8

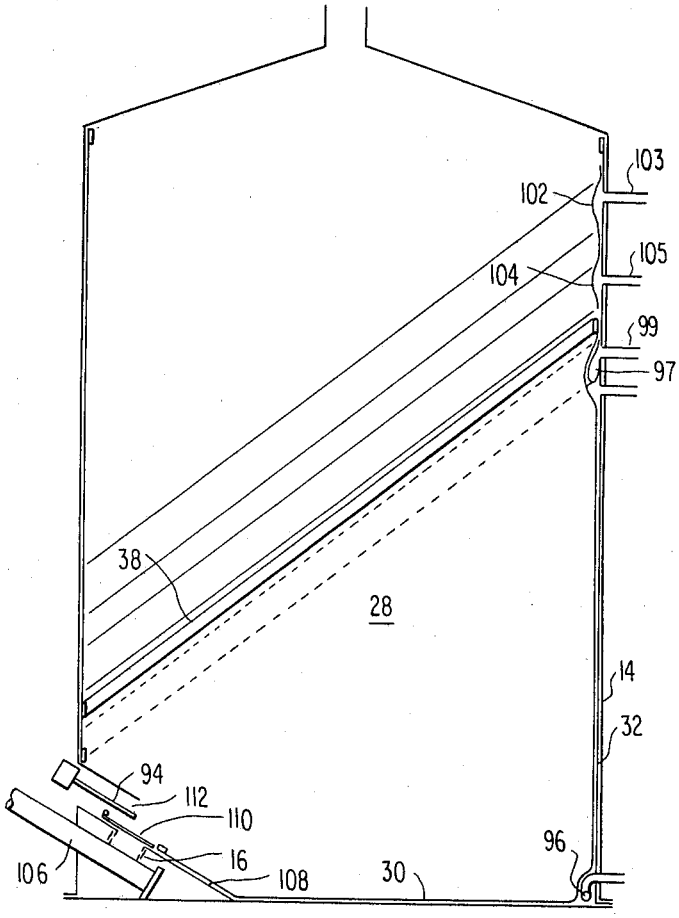
FIG. 10
FIG. 11A
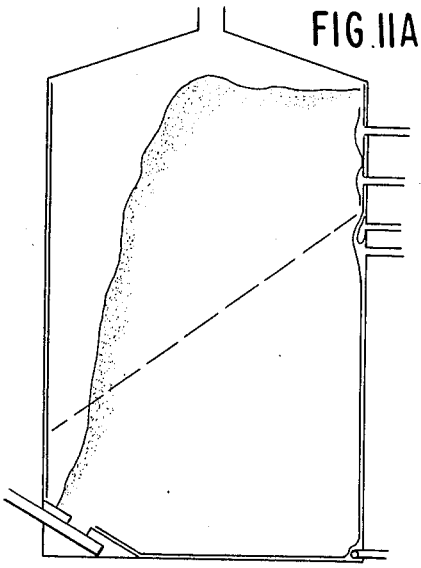
FIG. 11B
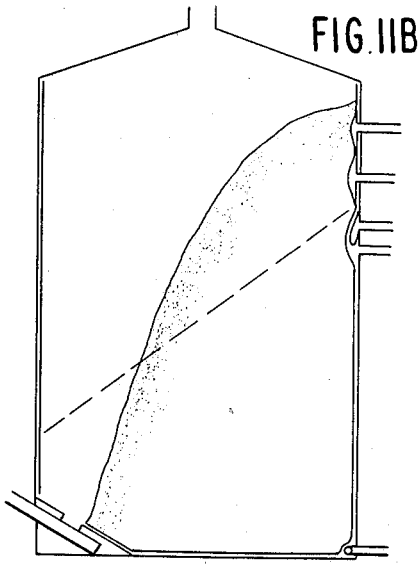
FIG. 11C
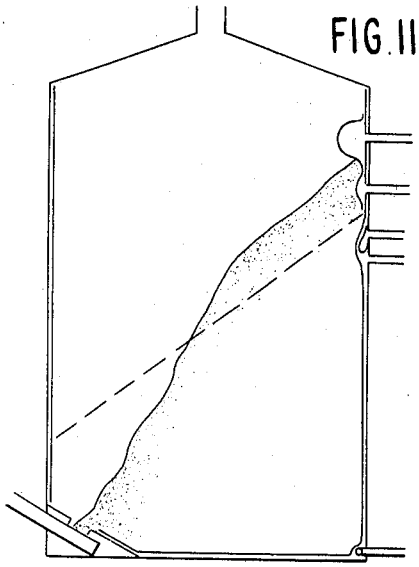
FIG. 11D
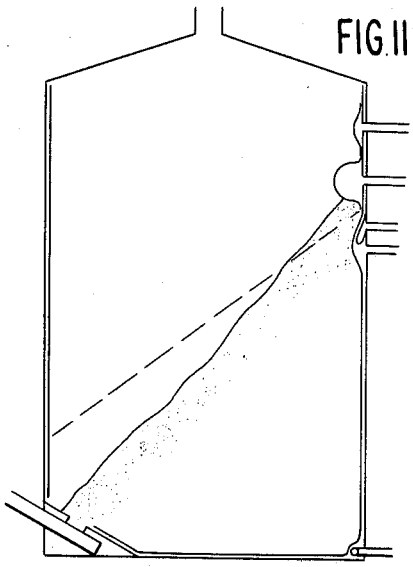

SIDE UNLOADING BIN FOR STORING AND DISCHARGING FREE-FLOWING GRANULAR MATERIAL

CROSS-REFERENCE TO RELATED INVENTIONS

This invention is a continuation-in-part of our application Ser. No. 257,604, filed Apr. 27, 1981, titled BIN FOR FREE-FLOWING MATERIAL, now U.S. Pat. No. 4,421,250, and application Ser. No. 307,089, filed Sept. 30, 1981, titled BIN FOR STORING AND DISCHARGING FREE-FLOWING GRANULAR MATERIAL, both assigned to the present assignee.

BACKGROUND

1. Field of the Invention

This invention relates to improvements in flexible-walled storage bins with fluid pressure-assisted discharge and particularly to a side-unloading bin with a uniquely shaped bag, a gated discharge opening, and automatic controls.

2. Prior Art

Numerous patents in the prior art illustrate utilization of a flexible membrane which is moved by fluid pressure to assist in moving various bulk materials. Examples of such prior art patents which we are aware of are U.S. Pat. Nos. 2,792,262; 2,956,839; 3,209,894; 3,396,762; and 3,421,663. However none of these prior art bins use a flat bottom, e.g. an existing floor to support the weight of the material over a large area, and then use an inflatable cup shaped bag for discharge assistance.

In our prior applications referenced above, we have disclosed flexible cup-shaped dual-walled inflatable bags supported on flat horizontal surfaces which utilized fluid pressure for inflating or moving the bag wall to discharge material that would otherwise remain in the bag after the material assumed its angle of repose.

The inventions of our prior applications referenced above require center unloading through a hole in the supporting floor which can adversely affect the integrity of the floor. The construction also makes it difficult to check any problems, such as contamination of the materials or a jam, at the point of discharge. Additionally the prior constructions, usually require the bin to be located above a floor resting on the earth, because there needs to be access from below the bottom. However, upper floors are not as able to withstand heavy loads as ground floors are.

SUMMARY OF THE INVENTION

The present invention utilizes the same general concept of the prior inventions, but in a side-unloading environment. That is, the present invention has the same advantage of significantly decreasing floor loading from the prior known conventional hoppers, and has additional advantages in that, because it can be emptied from the side, there is no need to provide a hole in the floor supporting the bin for discharging the bin contents. This not only provides greater convenience, but also easier access to the material stored in the bin. Additionally, the side unloading bin can be used on a ground floor, which is usually the strongest floor of a building and the contents of the side-unloading bin can be conveniently conveyed away. The center discharge bin of our prior applications requires a space below the floor for conveying away the contents.

Because the flexible walls of the material supporting bag inflate when unloading the bin, the inflation causes movement of the bag walls which provides a unique self-cleaning action and eliminates the common problems of "rat-holing" known with conventional storage silos. The side-unloading bin also allows easy access to the discharge area in case there are any plug-ups in that area. Additionally, controls connected to the inflation and discharge system ensure that there is a continuing discharge in alternating cycles, first by gravity and then by pneumatic pressure assistance from the supporting bag. After the discharge (with the self-cleaning action), the bag is deflated in such a manner, using a perforated vacuum hose, that it assumes its original condition, ready to receive another load of material.

BRIEF DESCRIPTION OF THE DRAWINGS

FIG. 1 is a schematic side elevation view of the side unloading bin of this invention and its controls;

FIG. 2 is a detail elevation view of a top cover of the bin;

FIG. 3 is a detail sectional view of the means for attachment of the bag to the bin walls;

FIG. 4 is an elevation view looking along line 4—4 of FIG. 1;

FIG. 5 is a detail sectional elevation of the discharge area of the bin;

FIG. 6 is a partial sectional elevation of another embodiment of the invention;

FIG. 7 is a view taken along line 7—7 of FIG. 6;

FIG. 8 is a partial sectional elevation of another embodiment of the invention;

FIG. 10 is a schematic side elevation of another embodiment of the side unloading bin of this invention.

FIGS. 11A–11D are a series of schematic views showing the sequence of conditions and actions in unloading the bin of FIG. 10.

DESCRIPTION OF THE PREFERRED EMBODIMENTS

Figure 9A:
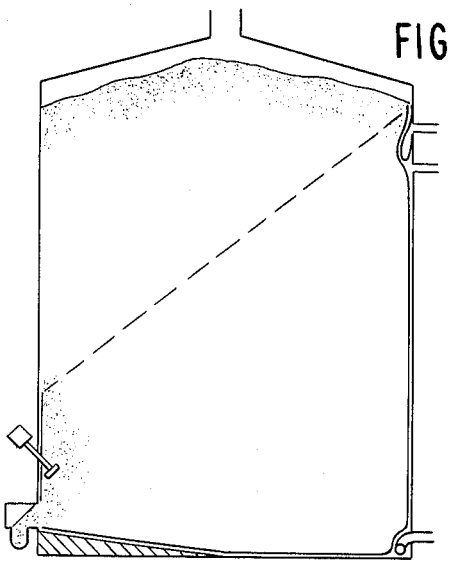
FIGS. 9A–9F are a series of schematic views showing the sequence of conditions and actions in unloading the bin.

Referring to FIG. 1, a bin 10 of this invention is especially suitable and adapted for bulk storage and handling (discharging) free flowing granular material. The bin is supported on a floor or other support 12 having suitable strength to bear the load of the material in the bin. The bin is constructed with side walls 14 which may be preferably light weight corrugated metal of the type commonly used for farm buildings and the like. The side walls 14 have formed therethrough a discharge opening 16 in the lower portion thereof.

The bin is optionally provided with a suitable top 18 which may be either metal or cloth and preferably has vent means therein (not shown) to allow venting of air from the bin when it is being filled while preventing loss of dirt size particulate material. A suitable loading chute 20 may be supported from the upper floor 22, for example. However, any suitable known means can be used for putting material to be stored into the bin.

The bin side walls 14 have flanges at both ends including flange 24 around the upper periphery of the side wall and flange 26 at the bottom edge of the side wall. Within the bin there is an inflatable bag 28 having an inner wall 30 and an outer wall 32. A portion of the outer wall 32 may be held beneath the lower flange 26 of the side wall 14 and an upper extension of inner bag wall 30 may be supported over the top of bin side wall flange 24. The bottom flange 26 is bolted or otherwise securely attached to the floor by conventional securing means, not shown.

There is provided through the outer wall 32 of the bag and wall 14 of the bin an inflation opening 34 and a deflation opening 36. Although the inflation opening is shown near the top of the cup shaped bag, it can be at any other suitable location.

The top of the double walled bag 28 is slanted and the top of the two walls are clamped together by a clamp 38. This clamp spirals around the bin from a high portion near the top of the bin opposite the discharge opening 16 to a lower portion above the discharge opening, see FIG. 1.

The clamp 38 is shown in detail in FIG. 3 and includes a pair of metal straps 40 sandwiching the ends of the inner and outer wall 30 and 32 and the end of inner wall extension 42 therebetween. The assembly is clamped together and clamped to the bin side wall 14 in numerous locations by a nut and bolt means 44. The ends of the flexible material bags may have rope 46 around them for securing in the clamp.

The inner and outer bag walls 30 and 32 may be glued together so that they may not inflate in a generally triangularly shaped area 48 extending above and outwardly from the discharge opening 16, see FIG. 4. This prevents the walls from separating upon inflation of the bag. However, such adherence was not necessary in handling sugar, and its use is optional. Both walls of the bag 28 are sealed around the discharge opening by a plate 50 abutting against a backup plate 51.

A discharge shroud 52 shown in detail in FIG. 5 extends outwardly from the bin discharge opening a distance sufficient so that the material in the bin can flow into the conveyor by gravity. The discharge shroud 52 includes a side wall 54, a top wall 56 and a bottom wall 58. A transparent hatch 60 having a handle 62 is hinged at 64 for closing the top of the discharge shroud and providing access to material therein. At the bottom of the shroud 52 there is a screen 66 for screening the material and a gate valve 68 which may be operated by handle 70. Below the discharge shroud and particularly below the gate valve 68 there is a screw type conveyor 72 in a conveyor housing 74 for conveying away material discharged. Because the discharge opening 16 is above the level of the floor 12 a built up floor segment 75 is provided.

For inflation and deflation of the bag there is provided a blower 76 having an outlet line 78 with valves 80 and 82 controlling whether the output of the blower is directed to inflating the inflatable bag 28 through line 86 or venting to atmosphere. Alternatively the blower could just be turned on when air pressure is required. Line 86 is provided with a check valve 88 to prevent collapsing of the bag during an emptying cycle or if the blower stops. There is a further line 87 connected to deflation opening 36 leading back to the inlet of the blower 76 and controlled by valves 90 and 92. A control box 84 is provided with suitable controls for controlling valves 80, 82, 90 and 92. The control box could also be used to directly control the switching on and off of the blower thus eliminating some of the automatically controlled valving. Manually controlled valves would then be used to select either inflation or deflation.

In connection with the controls, there is a material indicator 94 of the commercially available type which indicates when there is material flowing over it in the bin. This material indicator is positioned just adjacent the discharge in an area outside the angle of repose of the material and is connected electrically to the control box 84, or to directly control the blower.

A perforated vacuum hose 96 is positioned between the walls of the bag 28 at the outside periphery of the bottom to assure that the bag assumes its original position during deflation.

Figure 9B:
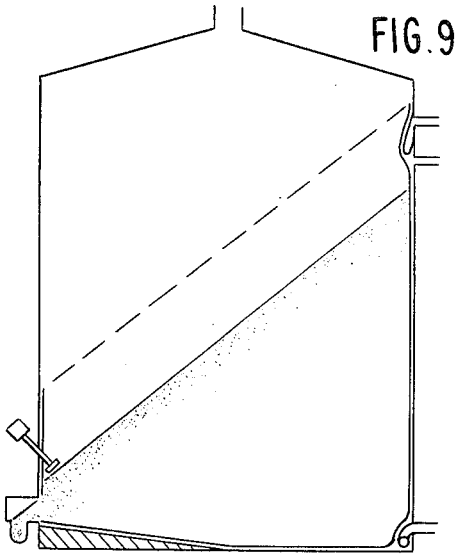
Figure 9C:
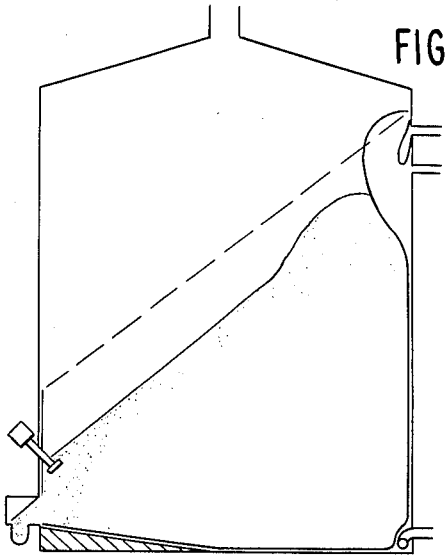
Figure 9D:
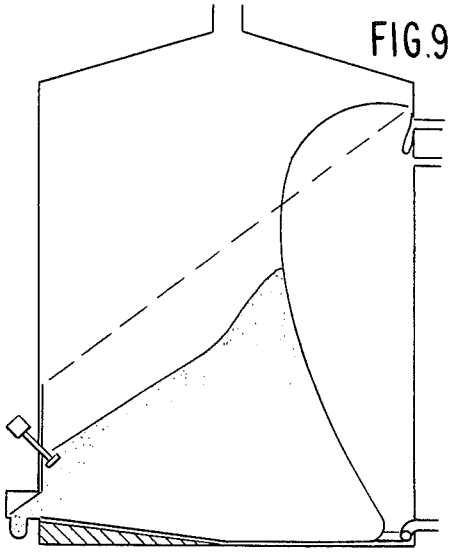
Figure 9E:
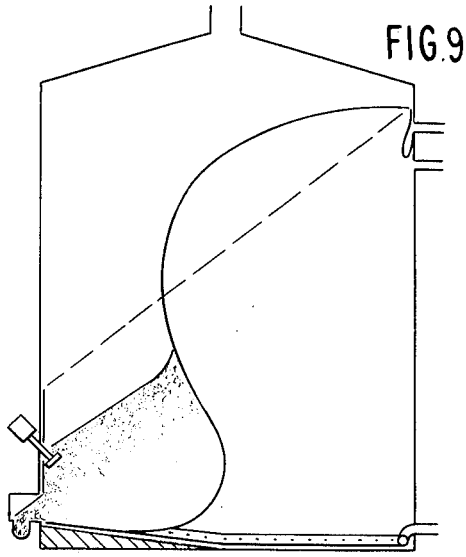
Figure 9F:
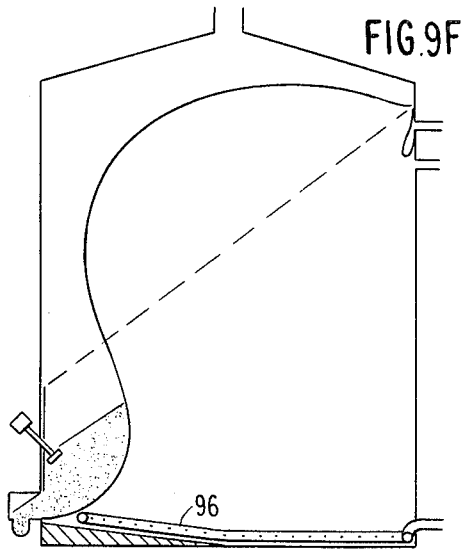

In operation, the bin 10 is initially filled with the bulk material to be stored, e.g. sugar, rice, corn, powders, grains, etc. This material should be free flowing material and of a type which can be handled within the bin. FIG. 9A shows the bin loaded with material. When it is desired to discharge material from the bin, gate 68 is opened by virtue of pulling on handle 70 and the material flows out of the bin and out of the discharge opening until such time as it approximates its angle of repose and uncovers the sensor of bin material indicator 94. At this time the material is in the condition of FIG. 9B. When it senses no material the bin level indicator 94 gives a signal to the control box 84 to start inflating the bag by relatively low pressure from the blower 76. The top of the bag 28 starts inflating by the inner wall 30 bulging inwardly as shown in FIG. 9C. The material continues to flow and the bag wall 30 continues to expand as shown in FIGS. 9D and 9E. During discharge when the material covers the indicator 94 the inflation stops, the check valve 88 holds the low pressure, and the material discharges by gravity until it again uncovers the indicator. This cycle is repeated during the discharge. Near the end of the emptying cycle the inner wall 30 of the bag 28 has raised off the bottom and lifted the small amount of sugar remaining into the discharge opening, see FIG. 9F. For deflating the bag and causing it to assume its original position, vacuum applied through perforated vacuum hose 96 draws the bottom of the inner bag wall into the bottom corners of the bin. Inflatable tube 97 is provided to assure that enough slack exists so that the walls of bag 28 are not unduly strained when the bag is again loaded with bulk materials.

If at any time during the discharge there was a problem it could be inspected through transparent hatch 60 and if access is required at the point of discharge the hatch can be opened.

FIGS. 6, 7 and 8 show alternative embodiments in which, for various spacial or structural reasons, it is desirable to have the discharge opening 16 several feet above the level of the floor 12. In the FIGS. 6 and 7 embodiments a false floor which may be installed on top of a honeycomb support 100 is positioned to raise the level of the bottom of the bin until a point just below the discharge opening 16.

FIG. 8 represents another approach to the problem in which the floor 12 has constructed on it a tapered false floor 102 tapering upwardly from a point at the floor opposite the discharge opening to a point above the floor and just below the discharge opening.

The advantage of both the FIG. 6 and FIG. 8 embodiments is in having the discharge opening above the level of the floor but not requiring the bag 28 to lift relatively heavy weight of material being discharged any significant distance.

FIG. 10 shows another and presently preferred embodiment. The parts illustrated in FIG. 10 which are substantially the same as those in FIG. 1 bear the same reference numerals. FIG. 10 for example has the same double walled slanted top bag 28 clamped to the walls by annular clamp 30. Additionally, the embodiment of FIG. 10 shows in more detail the inflatable tube 97 with an inflation opening 99 therefore. This inflatable tube or collar extends around the periphery of the bin below the clamp 38. By inflating tube 97 slack is provided for the inner wall 30 of bag 28. Thus, this slack is needed when loading the bag with heavy material which, e.g. causes the bag to conform to the corrugations of the outer wall 14. By allowing such strain to be absorbed by the air in the inflatable tube 97 strain is removed to a large extent from the clamp 38 and walls of the bag.

Additionally, inflatable tubes 102 and 104 may be placed at levels above the clamp 38 and provided with suitably inflation openings 103 and 105 for further assisting in the discharge of the materials if the top end of the inflatable bag does not reach the top side of the bin opposite the discharge opening.

In the FIG. 10 embodiment a conveyor 106 extends radially from the bin at an angle to the foor to provide discharge at a suitable level to equipment, further storage, etc. This conveyor is beneath a built up false floor 108 also extending at an angle across the segment of the floor 12 below the bin. A discharge opening 16 in the floor above the conveyor is closed by a hand operated slide gate 110. The indicator probe 94 is positioned above the discharge opening 16 and a access opening 112 is provided at its access port allows inspection of the discharge area.

In operation of this embodiment reference is had to FIGS. 11A–D consecutively. As shown in FIG. 11A the bulk material will flow by gravity at the discharge when the gate 110 is removed and the conveyor 106 is operative. To assist in discharge above the line of clamp 38 tube 102 is inflated, see FIG. 11C, and later tube 104 may be inflated as in FIG. 11D.

Figure 12A:
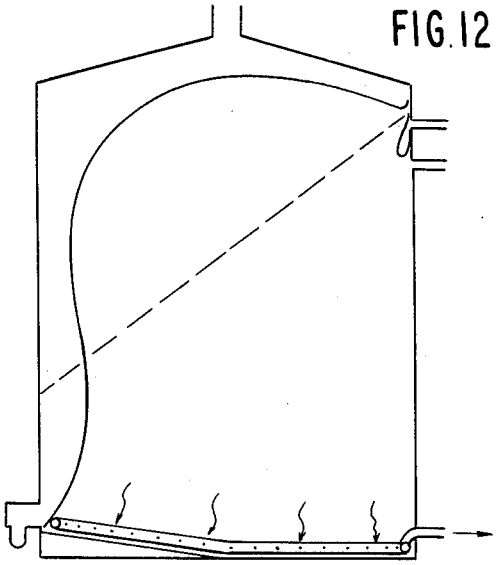
FIGS. 12A–12F are a series of schematic views showing the sequence of conditions and actions in deflating the flexible cup shaped bag.
Figure 12B:
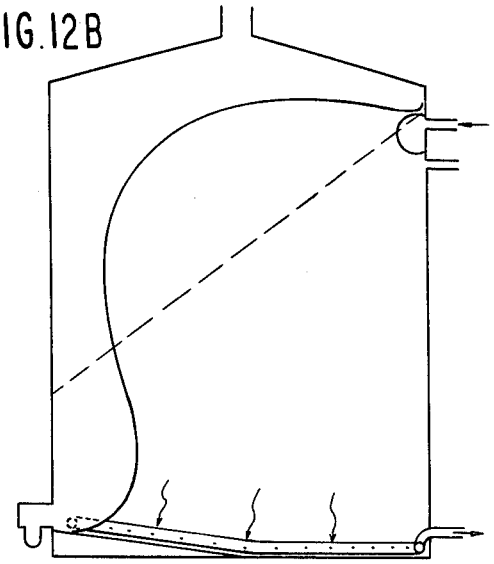
Figure 12C:
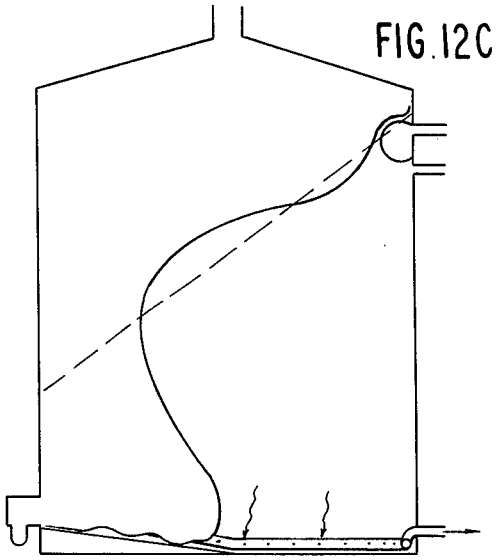
Figure 12D:
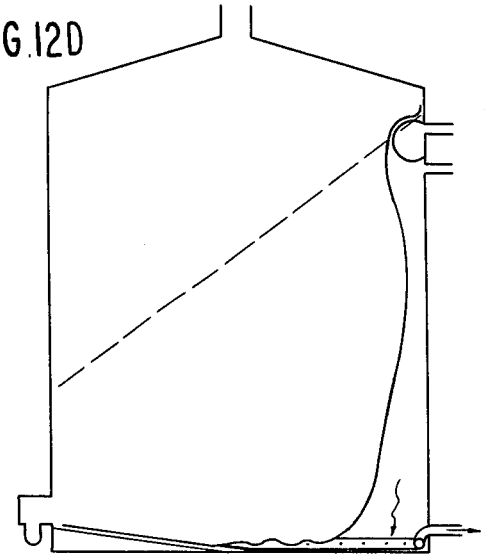
Figure 12E:
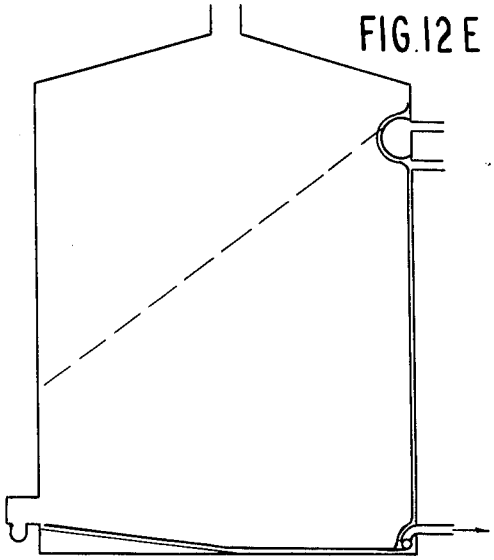
Figure 12F:
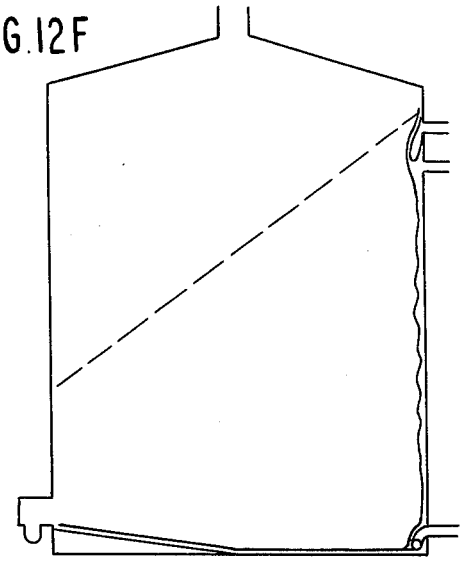

FIGS. 12A–F illustrate the use of the perforated vacuum tube or hose 96 and the inflatable bag 97 during the deflation and reloading of the bin. As seen in FIG. 12A deflation is starting and vacuum is applied to perforated vacuum hose 96 and at the same time inflatable tube 97 is inflated to bulge it, see FIG. 12B. Thereafter the bag gradually assumes its original position fitting snugly into the corners of the cylindrical bin as shown in FIGS. 12C, D and E. However, the inner wall will be bulged out to provide slack when loading the bin as shown in FIG. 12E. FIG. 12F shows how this slack is provided and such is useful in allowing the inner wall to conform to the corrugations in bin wall 14 and otherwise stretch as needed to fill voids when refilling the inner bag with the bulk material to be stored. The inflatable collar 97 may be inflated by the same power source that provides the vacuum to perforated vacuum hose 96.

As can be seen the invention disclosed above provides a unique pneumatically assisted handling and discharge means for granular free flowing material in which the bin for storing the material is simple and inexpensively constructed, it has uniform weight distribution over a supporting floor and can automatically assist in discharging material beyond the angle of repose by automatically inflating the supporting double walled bag. As compared with conventional bulk storage and hoppers the present invention presents dramatic differences in size of the silos required, shipping weight, erection time equipment and costs, floor loading, maintenance and cost.

We claim:

1. A side unloading bin for storing and discharging free-flowing material, supported on a floor capable of supporting the weight of the material stored in the bin, the bin comprising:
   (a) bin side walls secured to and upstanding from the floor,
   (b) discharge means for discharging material through the bin side wall means at a discharge area near the bottom thereof,
   (c) a flexible, inflatable, generally cup-shaped, slanted top, double-walled bag having its bottom resting on the floor, its sides normally adjacent and inside the bin side wall means, and having a discharge opening therethrough, the discharge opening located coextensive with the discharge area in the bin side wall, the top walls of the cup-shaped bag being attached to the inside of the bin side wall means in a continuous manner by clamp means from an area slightly above the discharge area on one side of the bin to a higher level on the other side of the bin,
   (d) the walls of the cup-shaped bag being sealed together to prevent separation in an area extending from the discharge opening and flaring outwardly and upwardly to the area slightly above the discharge opening where the bag is sealed to the side wall,
   (e) means for inflating the bag to cause the free-flowing granular material to flow by gravity through the bag discharge opening.

2. A bin according to claim 1 further comprising a discharge shroud extending outwardly from the bin side wall means at the discharge opening.

3. A bin according to claim 2 wherein the discharge shroud has a discharge gate in the bottom and an openable hatch in the top.

4. A bin according to claim 3 further comprising a conveyor positioned with a portion thereof beneath the discharge gate.

5. A bin according to claim 1 further comprising material detection means positioned in the bin adjacent the discharge opening to provide an output signal indicating whether material is flowing in an area immediately above the angle of repose adjacent the discharge opening, means connecting the output signal of the material detection means to control the inflation means so that the bag will inflate slightly before the bin is emptied to a level equal to the angle of repose of the material in the bin.

6. A bin according to claim 1 further comprising a false bottom extending from beneath the bag to the floor to raise the bottom of the bag to a position slightly below the discharge opening.

7. A bin according to claim 6 wherein the false bottom is of tapered height, with its highest point slightly below the bottom of the discharge opening.

8. A side unloading bin for storing and discharging free-flowing material, the bin supported on a support area capable of supporting the weight of the material stored in the bin, the bin comprising:
   (a) rigid, cylindrical bin side wall secured to and upstanding from the support area, the bin side wall having a discharge opening therein near the bottom thereof,
   (b) a flexible, fluid impervious, inflatable, generally cup-shaped, double-walled bag having its bottom normally resting on the support, its sides normally adjacent and lining the cylindrical bin side wall, the bag having a discharge opening therethrough mating with and connected to the discharge opening of the side wall, the bag having a slanted open top, (c) means continuously and rigidly attaching the slanted top of the bag to the bin side wall extending from a low point adjacent the discharge opening to a high point on the side of the bin opposite the discharge opening, (d) a built-up bin floor slanting downwardly and away from the discharge area starting from a point just below the discharge opening and extending downwardly toward the side of the bin opposite the discharge opening, (e) a material detection sensor positioned adjacent the discharge opening and above the bottom of the discharge opening to sense when the material in the bin is filling the discharge opening, (f) means controlled by the sensor for cyclically inflating the bag to cause the free-flowing granular material to flow by gravity to the discharge opening when the sensor senses that material is not filling the discharge opening.

* * * * *

UNITED STATES PATENT AND TRADEMARK OFFICE

CERTIFICATE OF CORRECTION

PATENT NO. : 4,476,998

DATED : October 16, 1984

INVENTOR(S) : Bonerb et al.

It is certified that error appears in the above-identified patent and that said Letters Patent is hereby corrected as shown below:

Col. 1, line 29, insert comma after "However";

line 33, insert hyphen between "cup" and "shaped";

line 34, change "our" to -- the --;

line 40, change "our" to -- the --;

line 46, insert comma after "Additionally" and delete comma after "constructions"; and line 66, change "our" to -- the --.

Col. 2, line 35, delete the period after "bin" and substitute semicolon;

line 37, delete the period after "invention" and substitute semicolon;

line 40, delete the period after "10" and substitute semicolon;

line 43, insert hyphen between "cup" and "shaped"; and

UNITED STATES PATENT AND TRADEMARK OFFICE

CERTIFICATE OF CORRECTION

PATENT NO. : 4,476,998

DATED : October 16, 1984

INVENTOR(S) : Bonerb et al.

It is certified that error appears in the above-identified patent and that said Letters Patent is hereby corrected as shown below:

Col. 2, line 49, insert hyphen between "free" and "flowing".

Col. 3, line 11, insert hyphen between "cup" and "shaped";

line 13, insert hyphen between "double" and "walled";

and line 32, delete "was" and insert therefor -- is --.

Col. 4, line 14, insert hyphen between "free" and "flowing";

and line 45, delete "was" and insert therefor -- were --.

Col. 5, line 6, delete "therfore" and substitute

-- therefor --;

line 17, delete "suitably" and substitute

-- suitable --;

line 22, delete "foor" and substitute -- floor --;

line 29, delete "a" and substitute -- an --;

UNITED STATES PATENT AND TRADEMARK OFFICE

CERTIFICATE OF CORRECTION

PATENT NO. : 4,476,998

DATED : October 16, 1984

INVENTOR(S) : Bonerb et al.

It is certified that error appears in the above-identified patent and that said Letters Patent is hereby corrected as shown below:

Col. 5, line 45, insert comma after "Thereafter"

line 60, insert hyphen between "free" and "flowing";

and line 62, insert -- and -- before "it".

Signed and Sealed this

*Seventeenth* Day of *September 1985*

[SEAL]

*Attest:*

DONALD J. QUIGG

*Attesting Officer*

*Commissioner of Patents and Trademarks—Designate*